United States Patent [19]

Ringwood

[11] 4,274,976

[45] Jun. 23, 1981

[54] TREATMENT OF HIGH LEVEL NUCLEAR REACTOR WASTES

[75] Inventor: Alfred E. Ringwood, Red Hill, Australia

[73] Assignee: The Australian National University, Australia

[21] Appl. No.: 54,957

[22] Filed: Jul. 3, 1979

[30] Foreign Application Priority Data

Jul. 14, 1978 [AU] Australia ..... PD5096
Nov. 17, 1978 [AU] Australia ..... PD6822

[51] Int. Cl.[3] ..... G21F 9/34

[52] U.S. Cl. ..... 252/301.1 W; 252/301.1 R; 264/0.5

[58] Field of Search ..... 252/301.1 W, 301.1 R; 264/0.5; 423/71

[56] References Cited

U.S. PATENT DOCUMENTS

| | | | |
|---|---|---|---|
| 3,000,072 | 9/1961 | Evans | 252/301.1 W |
| 4,172,807 | 10/1979 | Larker | 252/301.1 W |

OTHER PUBLICATIONS

Bonniaud et al., "Attempt at Incorporating . . . Micas", *Proc. 2nd U.N. Int'l. Conf. Peaceful Uses Atom. En.,* Geneva, 1958, vol. 18, pp. 33-36.

McCarthy et al., "Ceramic Nuclear Waste Forms I", *Am. Ceram. Soc. Bull.,* vol. 54, No. 9, (1975), pp. 782-786.

McCarthy et al., "Ceramic Nuclear Waste Forms II", *Am. Ceram. Soc. Bull.,* vol. 55, No. 2, (1976), pp. 190-194.

McCarthy, G. J., "Crystalline and Coated High-Level Forms", *Proc. Conf. High-Level Radioac. Solid Waste Forms.,* Denver, Colo., Dec. 1978, pp. 625-650.

"Nuclear Waste Disposal: Alternatives to Solidification in Glass Proposed", *Science,* vol. 204, (Apr. 1979), pp. 289-291.

McCarthy, G. J., "High-Level Waste Ceramics . . . ," *Nuclear Technol.,* vol. 32, (Jan. 1977), pp. 92-105.

*Primary Examiner*—Deborah L. Kyle
*Attorney, Agent, or Firm*—Bacon & Thomas

[57] ABSTRACT

A process for immobilizing high level radioactive waste (HLW) calcine comprises the steps of:

(1) mixing the HLW calcine with a mixture of oxides, the oxides in the mixture and the relative proportions thereof being selected so as to form a mixture which, when heated and then cooled, crystallizes to produce a mineral assemblage containing well-formed crystals capable of providing lattice sites in which elements of the HLW are securely bound, the crystals belonging to or possessing crystal structures closely related to crystals belonging to mineral classes which are resistant to leaching and alteration in appropriate geological environments and including crystals belonging to the titanate classes of minerals; and (2) heating and then cooling the mixture so as to cause crystallization of the mixture to a mineral assemblage having the elements of the HLW incorporated as solid solutions within the crystals thereof.

A mineral assemblage having elements of HLW calcine incorporated within the crystals thereof is also disclosed.

27 Claims, No Drawings

TREATMENT OF HIGH LEVEL NUCLEAR REACTOR WASTES

This invention relates to the treatment and disposal of high level radioactive wastes (HLW) from nuclear reactors, and in particular relates to a process for immobilisation of such wastes in a product which will safely retain dangerously radioactive isotopes in the waste for periods sufficient to ensure that they do not re-enter the biosphere prior to their effective decay.

Spent fuel from nuclear reactors such as are used in commercial power plants contains a wide range of highly radioactive isotopes. Because of the dangerous radiation which they emit, these isotopes must be disposed of in such a manner that they do not re-enter the biosphere during their effective decay periods. One group of these isotopes is formed by the fission of uranium (and plutonium). From the disposal point of view the most important components formed by such fission are 137Cs and 90Sr. These fission products have half-lives of about 30 years and must be contained for a period of about 600 years before they decay to safe levels. After 600 years, the dominant radioactive species in the waste are the actinide elements, principally isotopes of Pu, Am, Cm and Np which decay by the emission of alpha particles. After about a million years, the activity of the waste becomes comparable to that of the original uranium which was mined to produce the nuclear fuel. This is usually taken to be the ideal time limit for containment.

Assuming that the spent fuel rods are to be reprocessed to recover plutonium and unused uranium, they would be placed in cooling ponds for about a year to permit the decay of several highly radioactive, short-lived fission products. According to current commercial practice, the rods would then be chopped into sections and dissolved in nitric acid. Plutonium and uranium would be recovered from this solution, the remainder of which constitutes the high-level wastes.

The intention in most countries which operate commercial nuclear power plants is to transform these HLW solutions initially into a solid, insoluble form. This is accomplished in the first instance by evaporating the HLW solution to dryness and calcining the material to produce a fine-grained mixture of radioactive oxides—called "calcine". The principal components of a typical high level waste calcine resulting from fission of uranium (and plutonium) are set out in Table 1:

TABLE 1

Typical composition of calcined high level nuclear reactor wastes.

| | | Mole per cent |
|---|---|---|
| Rare earths (REE elements) | Fission Products | 26.4 |
| Zr | | 13.2 |
| Mo | | 12.2 |
| Ru | | 7.6 |
| Cs | | 7.0 |
| Pd | | 4.1 |
| Sr | | 3.5 |
| Ba | | 3.5 |
| Rb | | 1.3 |
| U + Th | Actinides | 1.4 |
| Am + Cm + Pu + Np | | 0.2 |
| Fe | Processing contaminants | 6.4 |
| $(PO_4)$ | | 3.2 |
| Na | | 1.0 |
| Others (mainly Tc, Rh, Te, I and processing contaminants (including Ni, Cr). | | 9.0 |

Calcine is an unsatisfactory form for disposal because of its low density, low thermal conductivity and high solubility. Thus, further processing of this material is necessary.

The most popular procedure advocated by the nuclear power industry has been to incorporate the HLW calcine into a borosilicate glass. This is accomplished by melting 20 to 30 percent of calcine with additional $SiO_2$, $B_2O_3$, ZnO, $Al_2O_3$ and $Na_2O$ to form a liquid which is allowed to cool to a glass in thick stainless steel cylinders. It is proposed to bury these glass cylinders in favourable geological environments. The glass so formed is quite resistant to leaching by water at 100° C. in the laboratory, and also to radiation damage. A typical composition of borosilicate glass containing HLW is set out in Table 2.

TABLE 2

| Component | Wt. % |
|---|---|
| $SiO_2$ | 27.3 |
| $B_2O_3$ | 11.1 |
| ZnO | 21.3 |
| $Na_2O + K_2O$ | 8.1 |
| MgO + CaO + SrO + BaO | 5.9 |
| High Level Waste | 26.3 |

The above proposal to immobilise HLW calcine in glasses nevertheless possesses some major disadvantages. Glasses are thermodynamically unstable relative to the chemically equivalent mixture of crystalline phases, and, when subjected to typical geological environments, may devitrify. This is likely to cause a drastic increase of leachability and permeability which would be highly undesirable for the long-term immobilisation of HLW elements. In particular, borosilicate glasses readily devitrify when subjected to the action of water and steam at elevated pressures and temperatures. It seems almost inevitable that devitrification would occur if glass cylinders were buried deeply in geological environments, in which water is almost universally present. Even salt beds, which are often proposed as repositories for HLW glasses, usually contain around 0.5 percent of small brine inclusions which would migrate towards the canisters of HLW glass because of the thermal gradient established by the decay of radioactive elements in the glass.

An alternative approach to the immobilisation of HLW calcine has been investigated by McCarthy and co-workers. [McCarthy, G. J., (1977). Nuclear Techn. 32, 92]. It is proposed that HLW calcines should be incorporated in ceramic materials composed of crystalline phases. The proposed ceramic host medium, which is termed "Supercalcine", is produced by adding about 30–50 percent of Si, Ca, Al and Sr oxides to the HLW solution before calcination. These components are added in carefully defined proportions (see for example Table 3 hereinafter) so that during calcination they will react with the HLW components to form a specific assemblage of desired crystalline phases possessing apatite, fluorite, scheelite, pollucite and spinel structures. The mixture of oxide additives and HLW calcine is heated at about 1200° C. to form a finely crystallized phase assemblage in which HLW elements are distributed according to the principles of chemical equilibrium. Leaching studies in water at 100° C. revealed that "Supercalcine" possessed a similar leachability to HLW-containing borosilicate glasses. A typical "Supercalcine" formulation is set out in Table 3 (McCarthy, 1977):

TABLE 3

| Millimoles in radwaste | Phase Composition | Structure | Required Additives |
|---|---|---|---|
| 420 REE* | 60 $Ca_3REE_7(SiO_4)_5$ | Apatite | 180 Ca |
| 60 $(PO_4)$ | $(PO_4)O_2$ | | 300 Si |
| 80 Cs | $80CsAlSi_2O_6$ | Pollucite | 80 Al |
| | | | 120 Si |
| 120 Mo | 120 $SrMoO_4$ | Scheelite | 120 Sr |
| 50 Sr | In Scheelite | | |
| 50 Ba | solid solution | | −100 Sr |
| 120 Zr | 120 $ZrO_2$ | Fluorite | |
| 80 Fe | 6 $Ni(Fe,Cr)_2O_4$ | Spinel | |
| 14 Cr | 41 $(Fe,Cr)_2O_3$ | Corundum | |
| 6 Ni | | | |

There are some important potential advantages of immobilising HLW in "Supercalcine" as compared to glass:

(a) Since "Supercalcine" is already crystalline, there is no risk of devitrification, as would occur in the case of glass, accompanied by a great increase in solubility.

(b) "Supercalcine" has a much greater thermal stability than glass. Accordingly, additional processing can be carried out, increasing its effectiveness. For example, "Supercalcine" pellets can be coated with a layer of inert, refractory alumina which would increase their resistance to leaching and corrosion.

(c) Because of higher thermal stability, HLW calcine can be incorporated in "Supercalcine" in greater concentrations (e.g. 50–70% by weight) than in glass (20–30%) and sooner after leaving the reactor.

(d) The fundamental principles of crystal chemistry and solid state chemistry which govern the formation of the crystalline phases are well understood. Predictions of long term behaviour of these phases in various environments can therefore be made. In comparison, understanding of the structure and behaviour of glasses at the atomic level is much less advanced, and reliable predictions cannot be made in the event of devitrification in the geological environment.

The above advantages are very significant. Unfortunately there are some accompanying disadvantages:

(a) "Supercalcine" contains about 50–70 percent of HLW calcine. Thus, the crystalline phase assemblage which is formed after incorporation of the added components is dictated, to a large degree, by the composition of the HLW calcine. The mineral assemblage so formed is not ideal for long-term containment of HLW components.

(b) One of the most troublesome HLW elements is 137Cs which, in "Supercalcine", is immobilized in the mineral pollucite, $CsAlSi_2O_6$. Recent experiments have shown that pollucite is appreciably soluble in excess water at high pressures and temperatures, particularly in the presence of sodium chloride, and could be selectively leached by ground-water.

(c) "Supercalcine" is prepared by heating under fairly oxidising conditions with the objective of converting molybdenum to the hexavalent state so that it can be fixed in a scheelite-type phase, $(Ca,Sr)MoO_4$. Under these redox conditions it is likely that technetium will occur as a soluble alkali pertechnate which could be readily leached by water. Ruthenium also displays appreciable volatility during heating under oxidising conditions.

(d) Because of its fine crystallite size, it has not yet been possible to characterize the mineral chemistry of "Supercalcine" in detail. The identification and characterisation of individual minerals has been based mainly on X-ray diffraction which possesses much less resolving power than electronprobe microanalysis (the latter technique requires larger crystals). Consequently, the detailed distributions of individual HLW elements among mineral phases have not been firmly established. Moreover, recent studies have shown that a substantial amount of amorphous or glassy material is present in "Supercalcine". The presence of this component raises the same problems as occur with borosilicate glasses.

(e) Because of the high loading of HLW in "Supercalcine", excessive radiation damage of some crystalline forms will occur. This is particularly severe for the relatively open apatite structure, which incorporates some of the actinide elements. Excessive radiation damage may enhance solubility of apatite and cause pronounced volume expansion, leading to cracking of the waste form and increased permeability.

(f) Some radioactive elements concentrated in particular lattice sites decay by transmutation to other elements which may not be stable in the same lattice sites. This problem may be most severe in the cases of 90Sr which decays to zirconium and 137Cs which decays to barium. Because of the high concentration of HLW in "Supercalcine", this effect may result in the destabilization of some crystalline phases, e.g. pollucite, apatite and scheelite.

(g) The combination of high HLW loading (implying a high rate of heat generation) and low thermal conductivity characteristics of "Supercalcine" prevents this material being buried underground in the form of large, discrete bodies.

(h) In order to obtain a product with optimum properties the proportion of additives in "Supercalcine" must be very carefully tailored at any one time to match the composition of the HLW calcine since the latter may vary substantially according to its source.

The present invention relates to a process for treatment and immobilisation of high level radioactive wastes which retains the advantages of the "Supercalcine" process and avoids the disadvantages. Moreover, it possesses several unique additional advantages.

The broad object of the present invention is to produce a range of synthetic rocks (in some instances hereinafter called SYNROC), composed of assemblages of synthetic minerals, each of which has the capability to accept high level radioactive waste elements into its crystal lattice and to retain them tightly. The invention provides a process whereby the HLW elements are immobilised in the form of dilute solid solutions within the minerals of these synthetic rocks. These are immune to devitrification and much more resistant to leaching than borosilicate glass. An important characteristic of the minerals chosen to make up the assemblage is that they belong to natural classes of minerals which are known to have been stable in a wide range of geochemical and geological environments for periods ranging from 20 million years to 2000 million years. It is this characteristic, combined with existing knowledge in the fields of geochemistry, mineralogy and solid state chemistry, which makes it possible to predict with a high degree of confidence, the capacity of the mineral assemblages of this invention to immobilise HLW elements for periods greatly exceeding the one million year interval necessary for decay of radioactive HLW elements to safe levels.

The proportion of HLW elements in the mineral assemblages of this invention is chosen so as to be much smaller than in "Supercalcine" where the HLW components are present in similar or greater abundances than the non-radioactive added components. This features has some important advantages:

(a) In "Supercalcine", it is the proportions of elements in the HLW which most strongly control the nature of the crystalline phase assemblage. As noted above, this greatly restricts flexibility and yields phase assemblages possessing some undesirable characteristics. However, if the added components exceed about 70 percent, they will control the nature of the crystalline phases produced. The radioactive atomic species will then simply substitute in low concentrations within the crystal lattices determined by the major added components, as in nature. This provides a great deal of flexibility in selecting a crystalline phase assemblage with the most desirable immobilization characteristics. An important characteristic of SYNROC, therefore, is that its particular mineral assemblage (see for example Table 4 hereinafter) remains essentially the same whether the HLW component amounts to 0%, 10% 20% or even 30%.

(b) Because the radioactive waste atoms are not major components, but are distributed as dilute solid solutions, the problems connected with transmutations and radiation damage can be greatly reduced and even eliminated. The flexibility conferred by the control of mineral structure by the inert additives means that specific mineral phases can be produced which are known to, or likely to possess the ability to retain transmutation products in stable lattice sites and to retain HLW species, even after suffering extensive radiation damage.

(c) Another advantage of the compositional flexibility of SYNROC is that well-formed crystalline host phases thereby produced have the same structures as natural minerals which are known to be extremely resistant to leaching and ion-exchange in appropriate geological environments.

(d) Because of the high dilution of radioactive waste elements in SYNROC, the host phases are far from being saturated with individual radioactive elements. Thus a given SYNROC mineralogy can incorporate a wide range of HLW compositions arising from different fuel cycles. In contrast, as noted above, the composition of "Supercalcine" must be varied to match each variant of HLW composition.

(e) Dilution of the HLW component in SYNROC greatly reduces the problems caused by radiogenic heat generation, so that larger integral bodies of SYNROC can safely be buried underground.

(f) The crystals of SYNROC are large and comparatively well formed (e.g. 5–1000 micron) as compared to those in "Supercalcine", much of which consists of sub-micron crystallites. As a result, it has been possible to accurately measure the composition of mineral phases in SYNROC and to determine the distribution of individual HLW elements between coexisting phases. In consequence, the detailed mineral chemistry of SYNROC is understood much better than that of "Supercalcine".

(g) It should also be noted that according to one preferred version of the present invention, SYNROC is produced by heating under relatively reducing conditions (near the Ni-NiO oxygen fugacity buffer). Under these redox conditions, molybdenum and technetium are present in the quadrivalent state as components of highly insoluble minerals. Moreover, ruthenium is not volatilized under these conditions, whilst caesium is fixed in a highly insoluble mineral.

According to one aspect of the present invention, there is provided a process for immobilising high level radioactive waste (HLW) calcine which comprises the steps of:

(1) mixing said HLW calcine with a mixture of oxides, the oxides in said mixture and the relative proportions thereof being selected so as to form a mixture which, when heated and then cooled, crystallises to produce a mineral assemblage containing well-formed crystals capable of providing lattice sites in which elements of said HLW are securely bound, the crystals belonging to, or possessing crystal structures closely related to crystals belong to mineral classes which are resistant to leaching and alteration in appropriate geologic environments, and including crystals belonging to the titanate classes of minerals; and (2) heating and then cooling said mixture so as to cause crystallisation of the mixture to a mineral assemblage having the elements of said HLW incorporated as solid solutions within the crystals thereof.

Preferably, a minor proportion of said HLW calcine is used in the mixture, for example, less than 30% by weight, more preferably 5–20% by weight.

According to a first exemplary method of performance of the invention, the oxides and relative proportions thereof in the mixture of oxides are selected to form a mixture which can be melted at temperatures of less than 1350° C. In order to obtain such melting temperatures, these mixtures will generally be selected to form mineral assemblages including both silicate and titanate minerals. The mixture is melted with a minor proportion of the HLW calcine and allowed to cool. During cooling, the melt crystallises to form the desired mineral assemblage and the HLW elements enter the minerals of this assemblage to form dilute solid solutions.

According to a second exemplary method of performance of this invention, the oxides and the relative proportions thereof in the mixture of oxides are selected so that the mixture may be heated at a temperature in the range 1000°–1500° C. without extensive melting of the mixture. Whilst such mixtures may be selected to form assemblages including both silicate and titanate minerals, generally the mixture will be selected to exclude the formation of silicate minerals in the assemblage. Heat treatment of the mixture with a minor proportion of HLW calcine to a temperature in the above range without excessive melting causes extensive recrystallisation and sintering, mainly in the solid state, and yields a fine grained form of the mineral assemblage in which the HLW elements are incorporated to form dilute solid solutions.

The products of each of the above methods, containing immobilised HLW elements, can then be safely buried in an appropriate geological environment.

In another aspect, the present invention also provides a mineral assemblage containing immobilised high level radioactive wastes, said assemblage comprising crystals belonging to, or possessing crystal structures closely related to crystals belonging to mineral classes which are resistant to leaching and alteration in appropriate geologic environments and including crystals belonging to the titanate classes of minerals, and said assemblage having elements of said high level radioactive waste incorporated as solid solutions within the crystals thereof.

In a first embodiment of the invention, the mixture of oxides which is used in accordance with the present invention comprises at least four members selected from the group consisting of CaO, $TiO_2$, $ZrO_2$, $K_2O$, BaO, $Na_2O$, $Al_2O_3$, $SiO_2$ and SrO, one of said members being $TiO_2$ and at least one of said members being selected from the sub-group consisting of BaO, CaO and SrO.

Preferably, in this embodiment the mixture comprises at least five members selected from said group, one of said members being $TiO_2$, at least one of said members being selected from the sub-group consisting of BaO, CaO and SrO, and at least one of said members being selected from the sub-group consisting of $ZrO_2$, $SiO_2$ and $Al_2O_3$.

If desired, in mixtures containing $Al_2O_3$, this component may be replaced partly or completely by the oxides of Fe, Ni, Co or Cr.

Preferably, in this embodiment the oxides and the proportions thereof are selected so as to form a mixture which, on heating and cooling, will crystallise to form a mineral assemblage containing crystals belonging to, or possessing crystal structures closely related to, at least three of the mineral classes selected from perovskite ($CaTiO_3$), zirconolite ($CaZrTi_2O_7$), a hollandite-type mineral ($BaAl_2Ti_6O_{16}$) barium felspar ($BaAl_2Si_2O_8$), leucite ($KAlSi_2O_6$), kalsilite ($KalSiO_4$), and nepheline ($NaAlSiO_4$).

In this particular embodiment of this invention, the oxides and their proportions may, for example, be selected so as to form a mineral assemblage containing crystals belonging to, or possessing crystal structures closely related to, a combination of mineral classes selected from the group of combinations consisting of perovskite-hollandite-barium felspar-zirconolite-leucite-kalsilite, perovskite-hollandite-barium felspar-zirconolite-leucite, perovskite-hollandite-kalsilite-barium felspar-zirconolite and perovskite-hollandite-barium felspar-nepheline-zirconolite.

A preferred mineral assemblage in accordance with this embodiment of the invention is perovskite-zirconolite-hollandite-barium felspar-kalsilite-leucite and a typical composition of this preferred mineral assemblage is given in Column A of Table 4 hereinafter. The mixture of oxides to form this composition may be melted at about 1300° C. and, during melting, about 10 percent of HLW added. When the melt is slowly cooled, it crystallizes completely to form the preferred mineral assemblage of this embodiment as described above. Alternatively, this mixture of oxides may be recrystallised in the solid state by heating at about 1200° C. with the addition of about 10 percent of HLW. Again, the product is the preferred mineral assemblage described above. It can be shown that nearly all HLW elements of Table 1 enter the above minerals to form stable solid solutions and thereby become immobilized in a form which is much more resistant to leaching than borosilicate glass and is not subject to devitrification. In particular, it can be shown that caesium, a highly dangerous HLW element, preferentially enters the kalsilite and leucite phases.

In a further development of this invention, it has now been discovered that it is possible to incorporate caesium in the hollandite phase as the component $Cs_2Al_2Ti_6O_{16}$, and that when incorporated in hollandite, caesium is remarkably resistant to leaching by aqueous solutions, even more so than when incorporated in kalsilite and leucite. Accordingly, the above described embodiment may be modified so as to cause the caesium to enter the hollandite phase. In order to achieve this objective, it is necessary to remove the silicate phases, such as barium felspar, kalsilite and leucite from the mineral assemblages particularly described above so as to produce a simplified mineral assemblage which may, for example, consist essentially of perovskite, zirconolite and hollandite-type minerals.

In accordance with a second embodiment of the present invention, therefore, the mixture of oxides comprises at least three members selected from the group consisting of BaO, $TiO_2$, $ZrO_2$, $K_2O$, CaO, $Al_2O_3$ and SrO, one of said members being $TiO_2$ and at least one of said members being selected from the sub-group consisting of BaO, CaO and SrO.

Preferably, in this embodiment the mixture comprises at least four members selected from said group, one of said members being $TiO_2$, at least one of said members being selected from the sub-group consisting of BaO, CaO and SrO, and at least one of the members being selected from the sub-group consisting of $ZrO_2$ and $Al_2O_3$.

If desired, in mixtures containing $Al_2O_3$, this component may be replaced partly or completely by the oxides of Fe, Ni, Co or Cr.

Since the mineral assemblages of this embodiment do not include the silicate phases, the mixtures of oxides in accordance with this embodiment exhibit of large increase in melting temperature and because of this it is preferred to form these mineral assemblages by heating and recrystallization in the solid state, using the technique known as "hot-pressing", or alternatively by sintering without application of pressure.

Preferably, in this embodiment, the oxides are selected so as to form a mixture which will crystallize to form a mineral assemblage containing crystals belonging to, or possessing crystal structures closely related to at least two of the mineral classes selected from perovskite ($CaTiO_3$), zirconolite ($CaZrTi_2O_7$) and hollandite-type mineral phases ($BaAl_2Ti_6O_{16}$). Still more preferably, each of the mineral assemblages would contain a hollandite-type mineral as an essential phase. Other hollandite-type mineral phases which can be employed instead of $BaAl_2Ti_6O_{16}$ include $K_2Al_2Ti_6O_{16}$ and $SrAl_2Ti_6O_{16}$, and their solid solutions. As described above, various divalent and trivalent atoms can also be introduced into the hollandite-type mineral phase, replacing or partially replacing Al. Such hollandite-type mineral phases include $Ba(Fe,^{II}Ti)Ti_6O_{16}$, $Ba(Co,Ti)Ti_6O_{16}$, $Ba(Ni,Ti)Ti_6O_{16}$, $BaCr_2Ti_6O_{16}$, and $BaFe_2^{III}Ti_6O_{16}$. Particularly preferred in this embodiment of the invention is a mixture of oxides which will crystallize to form a mineral assemblage comprised of crystals of, or possessing crystal structures closely related to all three of the above-designated mineral classes. A typical composition of this preferred assemblage is given in column B of Table 4 hereinafter.

According to a preferred method of carrying out both of the above-described methods of performance of the invention, the heat treatment (either melting and crystallizing, or recrystallizing in the solid state) is carried out under mildly reducing conditions, for example at an oxygen fugacity in the neighbourhood of the nickel-nickel oxide buffer. This may be achieved by adding a small amount of a melt such as nickel to the mixture, or by carrying out the heat treatment under a reducing atmosphere, for example in a gaseous atmosphere containing no free oxygen and a small amount of a reducing gas such as hydrogen and/or carbon monoxide. As a result of the heat treatment under these conditions, molybdenum and technetium in the HLW are reduced to the tetravalent species $Mo^{4+}$ and $Tc^{4+}$ whereby they readily replace titanium $Ti^{4+}$ in the hollandite, perovskite and zirconolite phases, thereby becoming insoluble and immobilised. Moreover, the volatility of ruthenium is minimised by heating under reducing conditions, while caesium enters the hollandite and/or leucite and kalsilite phases as described above.

If, however, the heat treatment is carried out under highly oxidising conditions, e.g., in air, much of the molybdenum and technetium is oxidised to $Mo^{6+}$, $Tc^{6+}$ and $Tc^{7+}$. They may then form soluble alkali molybdates, technates and pertechnates which could be readily leached by ground water. Moreover, ruthenium may be volatile under oxidising conditions, whilst some of the caesium may also form soluble molybdates and pertechnates.

The first step in producing an effective mineral assemblage for immobilising HLW elements in accordance with the present invention is to select appropriate classes of minerals which have demonstrated high degrees of resistance to processes of leaching and alteration in a wide range of geological environments for periods exceeding 20 million years, and which possess crystal chemical properties which permit them to accept HLW elements into solid solution in their lattice sites where they can be securely bound. Of course, in accordance with the present invention, at least one of the selected mineral classes will belong to the titanate classes of minerals.

The second step in producing an effective mineral assemblage is to select particular combinations of these minerals and of others possessing analogous properties, which are thermodynamically compatible when heated to high temperatures, and which, after being heated, can be crystallized completely into well-formed crystals in which HLW elements can be effectively immobilised.

The immobilisation of HLW elements in the mineral assemblages of this invention is then accomplished by an appropriate use of one of the above described methods of performance.

In either case, the heat-treatment may be carried out under a confining pressure and yields a fine grained mineral assemblage in which the HLW elements are incorporated to form dilute solid solutions. The product, containing immobilized HLW elements, can then be safely buried in an appropriate geologic environment.

It is emphasised that although some of the minerals used in the assemblages of this invention have compositions identical with natural minerals, the overall chemical compositions of these assemblages possessing the properties described above do not resemble those of any known kind of naturally occurring rock.

Table 4 sets out specific compositions according to two preferred embodiments of the invention as described below. The compositions of two alternative crystalline ceramic materials for HLW immobilization as disclosed in the prior art are given in Columns C and D for comparison. Table 5 shows the compositions of individual mineral phases as determined by electron-probe microanalysis from experiments carried out on mixtures A and B of Table 4.

TABLE 4

| | A | B | C | D |
|---|---|---|---|---|
| Mineral Structure | "Hollandite"<br>Perovskite<br>Zirconolite<br>Ba—felspar<br>Kalsilite<br>Leucite | "Hollandite"<br>Perovskite<br>Zirconolite | Scheelite<br>Cubic $ZrO_2$<br>Spinel<br>Apatite<br>Corundum<br>Pollucite | Rutile<br>Cubic $ZrO_2$<br>Metal<br>$Gd_2Ti_2O_7$<br>Amorphous $SiO_2$<br>Pollucite |
| Radwaste (wt. %) | 10 | 10 | 50 | 25 |
| inert Additives (wt. %) | 90 | 90 | 50 | 75 |
| wt. % | | | | |
| $SiO_2$ | 13 | — | 68 | minor |
| $TiO_2$ | 33 | 60.4 | — | ~90 |
| $ZrO_2$ | 10 | 9.9 | — | — |
| $Al_2O_3$ | 16 | 11.0 | 11 | minor |
| CaO | 6 | 13.9 | 19 | — |
| BaO | 17 | 4.2 | — | — |
| SrO | — | — | 2 | — |
| NiO | — | 0.6 | — | — |
| $Na_2O$ | — | — | — | minor |
| $K_2O$ | 5 | — | — | — |

Notes:
Column C refers to "Supercalcine" (McCarthy, G.J.) (1977), Nuclear Techn., 32,92.)
Column D refers to a ceramic developed by Sandia Corporation (Schwoebel and Johnstone (1977), ERDA Conf. 770102,101).

TABLE 5

Compositions of co-existing phases in SYNROC crystallized from both compositions shown in Column A and B of TABLE 4.

Composition A[1] : Melted and cooled from 1330 to 1100° C. at 2° C./min (Pt capsule)

TABLE 5-continued

Compositions of co-existing phases in SYNROC crystallized from both compositions shown in Column A and B of TABLE 4.

| | A | B | C | D | E | F |
|---|---|---|---|---|---|---|
| | Hollandite | Perovskite | Zirconolite | Ba—felspar | Kalsilite[2,3] | Leucite[2] |
| $SiO_2$ | — | — | — | 34.7 | 33.6 | 41.2 |
| $TiO_2$ | 73.0 | 57.1 | 41.6 | — | — | — |
| $ZrO_2$ | — | — | 41.0 | — | — | — |
| $Al_2O_3$ | 15.4 | 0.2 | 2.2 | 26.3 | 31.0 | 23.8 |
| BaO | 8.0 | — | — | 36.9 | 8.5 | 16.0 |
| CaO | 0.3 | 42.7 | 15.2 | — | — | 0.1 |
| $K_2O$ | 3.0 | — | — | 2.0 | 25.4 | 13.3 |
| $Cs_2O$ | <0.1 | — | — | 0.2 | 0.9 | 5.2 |
| Sum | 99.7 | 100.0 | 100.0 | 100.0 | 99.4 | 99.6 |

Composition B: Synthesized 1300° C. for 0.5 hr. (Ni capsule, subsolidus)

| | G | H | I |
|---|---|---|---|
| | Hollandite | Perovskite | Zirconolite |
| $TiO_2$ | 73.2 | 58.1 | 48.4 |
| $ZrO_2$ | 0.3 | 0.5 | 32.0 |
| $Al_2O_3$ | 12.6 | 0.3 | 3.3 |
| BaO | 12.3 | — | — |
| NiO | 1.5 | — | 0.3 |
| CaO | 0.3 | 41.1 | 16.1 |
| $Cs_2O$ | — | — | — |
| Sum | 100.2 | 100.0 | 100.1 |

[1]Doped with 1% $Cs_2O$
[2]Kalsilite and leucite-type solid solutions contain substantial amounts of $BaAl_2O_4$ and $BaAl_2SiO_6$ components respectively.
[3]In the absence of leucite, kalsilite takes up to 6% $Cs_2O$ The present invention is further illustrated, by way of example only, in the following Examples.

EXAMPLE 1

A mixture of oxides as set out in Column A of Table 4 above is selected to correspond to a desired mineral assemblage: perovskite $CaTiO_3$, Ba felspar $BaAl_2Si_2O_8$, hollandite $BaAl_2Ti_6O_{16}$, kalsilite $KAlSiO_4$, and zirconolite $CaZrTi_2O_7$. Ninety percent by weight of this mixture is intimately mixed with 10 percent of HLW calcine (Table 1.) The combined mixture is then melted in a suitable furnace at about 1330° C. under mildly reducing conditions and allowed to cool over a period of 2 hours to a temperature of 1100° C., at which stage essentially complete solidification is achieved. The resultant product is found to be well-crystallized and composed mainly of the 5-phase mineral assemblage: perovskite-hollandite-Ba felsparzirconolite-kalsilite. However, because of the partial substitution of potassium for barium in the hollandite lattice, and the non-stoichiometry of the hollandite phase, crystallization occurs during cooling in such a direction that the residual liquids are enriched in potassium, barium and silica. From this residual liquid, a K-Ba-aluminosilicate possessing the leucite structure is observed to crystallize. Compositions of these phases as determined by electronprobe microanalyses are given in Table 5.

The distribution of HLW elements among the major phases of the mineral assemblage of Example I has been determined by electronprobe microanalyses of coexisting phases. It is found that the rare earths and actinide elements dominantly enter the perovskite and zirconolite phases to form stable solid solutions, whilst molybdenum and ruthenium likewise enter the perovskite and hollandite phases replacing titanium providing that the synthetic rock composition is melted under appropriate redox conditions. Strontium is found to become preferentially incorporated in the perovskite phase, whilst barium enters the Ba felspar, and to a lesser degree, the hollandite phase. Rubidium mainly substitutes for potassium in the leucite phase, in the $KAlSiO_4$ phase and also in the Ba felspar phase. Zirconium enters the zirconolite phase whilst palladium becomes reduced to the metallic state. During crystallization of the mineral assemblage, caesium tends to become enriched in the residual liquid, and finally becomes incorporated mainly in the leucite phase and/or in a $(K,Cs)AlSiO_4$ solid solution which possesses the $RbAlSiO_4$ structure. Some caesium is also found to occur in solid solution in Ba felspar.

EXAMPLE 2

A mixture of oxides is selected so that when the mixture is heated, the oxides combine together to form a mineral assemblage consisting of $BaAl_2Ti_6O_{16}$ hollandite (25%), $CaZrTi_2O_7$ zirconolite (20%), $BaAl_2Si_2O_8$ barium felspar (20%, $CaTiO_3$ perovskite (15%) and $KAlSi_2O_6$ leucite (20%). Ninety percent of this mixture is intimately mixed with 10 percent of HLW calcine (Table 1), and the combined mixture is then heat-treated under reducing conditions as described in Example 1. The resultant product is found to be well-crystallized and composed mainly of the 5-phase mineral assemblage: perovskite-hollandite-Ba felspar-zirconolite-leucite. The distribution of the HLW elements among coexisting phases is similar to Example 1 except that nearly all of the caesium is found in solid solution in the leucite-type phase as a $KAlSi_2O_6$-$CsAlSi_2O_6$ solid solution.

EXAMPLE 3

A mixture of oxides is selected so that when the mixture is heated, the oxides combine together to form a mineral assemblage consisting of $BaAl_2Ti_6O_{16}$ hollandite (25%), $CaZrTi_2O_7$ zirconolite (20%), $BaAl_2Si_2O_8$ barium felspar (20%), $CaTiO_3$ perovskite (15%) and $NaAlSiO_4$ nepheline (20%). Ninety percent of this mixture is intimately mixed with 10 percent of HLW calcine (Table 1) and the mixture is then heat treated under reducing conditions as described in Example 1. The resultant product is found to be well-crystallized and composed mainly of the 5-phase mineral assemblage: perovskite-hollandite-Ba felspar-zirconolite-nepheline. The distribution of HLW elements among coexisting phases is similar to Example 1 except that nearly all of the caesium is found in the nepheline phase.

EXAMPLES 4,5 and 6

Mixtures of oxides are selected as described in Examples 1, 2 and 3, respectively and 95 percent of each oxide mixture is intimately mixed with 5 percent of HLW calcine (Table 1). Each mixture is then heat treated under reducing conditions as described in Example 1.

The products are found to correspond essentially to the mineral assemblage described in Examples 1, 2 and 3 respectively.

EXAMPLES 7, 8 and 9

Mixtures of oxides are selected as described in Examples 1, 2 and 3, respectively, and 80 percent of each oxide mixture is intimately mixed with 20 percent of HLW calcine (Table 1). Each mixture is then heat treated under reducing conditions as described in Example 1.

The products are found to correspond essentially to the mineral assemblages described in Examples 1, 2 and 3 respectively.

EXAMPLE 10

A mixture of oxides as set out in Column B of Table 4 hereinbefore is selected so that when the mixture is heated, the oxides combine together to form a mineral assemblage consisting of $BaAl_2Ti_6O_{16}$ hollandite, $CaZrTi_2O_7$ zirconolite and $CaTiO_3$ perovskite. Ninety percent of this mixture is intimately mixed with 10 percent of HLW calcine (Table 1). The combined mixture is then heated to about 1300° C. for about half an hour in the presence of metallic nickel and simultaneously subjected to a confining pressure (e.g. 1000 atmospheres) using the conventional technique known as "hot-pressing". The resultant product is found to be a fine grained, mechanically strong assemblage of hollandite, zirconolite and perovskite possessing the above compositions.

The distribution of HLW elements among the major phases of the mineral assemblage of Example 10 has been determined by electronprobe microanalyses of coexisting phases and is summarised in Table 6 hereinafter. It is found that caesium enters the hollandite phase as $Cs_2Al_2Ti_6O_{16}$, strontium dominantly enters perovskite as $SrTiO_3$ and the actinide elements dominantly enter the zirconolite phase, in each case, forming dilute solid solutions.

Samples of the product of Example 10 have been subjected to leaching tests by pure water and by water—10% NaCl solution at high temperatures and pressures. It has been found that the mineral assemblage remains stable and caesium remains incorporated in hollandite when subjected to leaching at temperatures up to 900° C., combined with pressure up to 5 kilobars over a period of 24 hours. For comparison, a representative selection of borosilicate glasses devitrified and disintegrated at temperatures above 350° C. Moreover, the alternative crystalline waste form "Supercalcine" was found to exchange its caesium for sodium at temperatures above 400° C. These experiments demonstrate the remarkable stability of the product of the present invention and its superiority over other immobilisation forms.

TABLE 6

| "Hollandite" | Zirconolite | Perovskite |
|---|---|---|
| $Cs^+$ $Mo^{4+}$ | $U^{4+}$ | $Sr^{2+}$ |
| $Rb^+$ $Ru^{4+}$ | $Th^{4+}$ | $REE^{3+}$ |
| $K^+$ $Rh^{3+}$ | $Pu^{4+}$ | $Y^{3+}$ |
| $Na^+$ $Fe^{3+}$ | $Cm^{4+}$ | $Am^{3+}$ |
| $Ba^{++}$ $Cr^{3+}$ | $Am^{3+}$ | $U^{4+}$ |
| $Pb^{++}$ $Ni^{2+}$ | $Y^{3+}$ | $Th^{4+}$ |
| $Fe^{2+}$ | $REE^{3+}$ | $Cm^{4+}$ |
| | $Na^+$ | $Pu^{4+}$ |

Table 6 is a summary of observed preferential distributions of HLW elements in solid solution in phases of the mineral assemblage of the composition given in Column B, Table 4, produced in accordance with Example 10. The quadrivalent actinides are more strongly partitioned into the zirconolite phase than into perovskite. Trivalent actinides preferentially enter zirconolite; however, in the presence of somewhat higher $Al_2O_3$ concentrations than shown in Table 4, Column B, the trivalent actinides may instead preferentially enter the perovskite phase.

EXAMPLE 11

The procedure of Example 10 is repeated except that the proportion of mixed oxide additives to HLW calcine is 80 to 20 by weight. The product is a mineral assemblage essentially similar to the product of Example 10.

EXAMPLE 12

The procedure of Example 10 is repeated except that the proportion of mixed oxide additives to HLW calcine is 95 to 5 by weight. Again, the product is a mineral assemblage essentially similar to the product of Example 10.

EXAMPLE 13

A mixture of oxides is selected so that when the mixture is heated, the oxides combine together to form a mineral assemblage consisting of $BaAl_2Ti_6O_{16}$ hollandite (50%) and $CaZrTi_2O_7$ zirconolite (50%), the actual composition of the minerals resembling those in Table 5, Columns G and I. From 5 to 20 percent of HLW calcine is then intimately mixed with 95 to 80 percent of the above oxide mixture and the combined mixture heat-treated as in Example 10. It is found that nearly all actinide elements in the HLW enter the zirconolite whilst strontium becomes partitioned between hollandite and zirconolite, mostly entering zirconolite. Other HLW elements including caesium enter the hollandite as in Example 10.

EXAMPLE 14

A mixture of oxides is selected so that when the mixture is heated, the oxides combine together to form a mineral assemblage consisting of $BaAl_2Ti_6O_{16}$ hollandite (50%) and $CaTiO_3$ perovskite (50%), the actual compositions of these minerals resembling those in Table 5, Columns G and H. From 5 to 20 percent of HLW calcine is then intimately mixed with 95 to 80 percent of the above oxide mixture and the combined mixture heat-treated as in Example 10. It is found that the actinide elements and strontium in the HLW enter the perovskite, whilst caesium and the other elements of the HLW continue to enter the hollandite as in Example 10.

EXAMPLE 15

The procedures of Examples 10–12 and 14 are repeated except that $CaTiO_3$ perovskite is replaced by $SrTiO_3$ perovskite.

EXAMPLE 16

The procedures of Examples 10–14 are repeated except that $CaTiO_3$ perovskite is replaced where present by $SrTiO_3$ perovskite, and $BaAl_2Ti_6O_{16}$ holandite is replaced by $SrAl_2Ti_6O_{16}$ hollandite.

The above Examples 1 to 16 demonstrate how the HLW elements in HLW calcine can be firmly incorporated in stable solid solutions within the minerals of an appropriately selected assemblage. The product of each Example containing the immobilized HLW elements can be safely buried in an appropriate geological-geochemical environment.

The results obtained from investigation of mineral assemblages produced in accordance with this invention demonstrate that when HLW products are treated by the processes described herein, they can safely be confined for periods of millions of years. By such means, the biosphere can be protected from the radiologic hazards posed by high level wastes from nuclear reactors.

The compositions of two other crystalline ceramic waste forms proposed for nuclear waste immobilisation have been given above in Table 4, Columns C and D. It is seen that the compositions and mineralogies of these ceramic waste forms differ drastically from those of the mineral assemblages comprising the synthetic rock described in this invention. It should also be noted that in the waste forms designated in columns C and D, caesium is present as the mineral pollucite. This mineral readily loses its caesium when subjected to the action of aqueous solutions containing sodium at temperatures above 300° C. In comparison, caesium remains firmly incorporated in hollandite-type mineral phases at temperatures up to 900° C. under otherwise similar conditions.

It will be appreciated by persons skilled in this art that many modifications and variations may be made to the specific embodiments described herein without departing from the spirit and scope of the present invention as broadly described herein.

I claim:

1. A process for immobilising high level radioactive waste (HLW) calcine which comprises the steps of:

(1) mixing said HLW calcine in a minor proportion with a mixture of oxides, the oxides in said mixture and the relative proportions thereof being selected so as to form a mixture which, when heated and then cooled, crystallises to produce a mineral assemblage containing well-formed crystals capable of providing lattice sites in which elements of said HLW are securely bound, the crystals belonging to or possessing crystal structures closely related to crystals belonging to mineral classes which are resistant to leaching and alteration in appropriate geological environments and comprising crystals belonging to or possessing crystal structures closely related to at least two of the titanate mineral classes selected from the group consisting of perovskite ($CaTiO_3$), zirconolite ($CaZrTi_2O_7$) and hollandite-type ($BaAl_2Ti_6O_{16}$) mineral classes; and (2) heating and then cooling said mixture so as to cause crystallisation of the mixture to a mineral assemblage having the elements of said HLW incorporated as solid solutions within the crystals thereof.

2. A process according to claim 1 wherein said minor proportion of said HLW calcine is less than 30% by weight.

3. A process according to claim 2, wherein said minor proportion of said HLW calcine is 5–20% by weight.

4. A process according to claim 1 wherein the oxides and the relative proportions thereof in said mixture of oxides are selected to form a mixture of oxides having a melting point of less than 1350° C., and said heating step comprises heating said mixture of HLW calcine and said oxides to a temperature sufficient to melt said mixture.

5. A process according to claim 1, wherein the heat treatment of said HLW/oxide mixture is carried out under mildly reducing conditions.

6. A process according to claim 5, wherein the heat treatment is carried out in the presence of a metal.

7. The process of claim 6 wherein said metal is nickel.

8. A process according to claim 5, wherein the heat treatment is carried out under a reducing atmosphere.

9. A process according to claim 8, wherein the reducing atmosphere is a gaseous atmosphere containing no free oxygen and containing a reducing gas.

10. The process of claim 9 wherein said reducing gas is hydrogen and/or carbon monoxide.

11. A process according to claim 1 wherein the oxides and the relative proportions thereof in the mixture of oxides are selected to that said mixture of oxides may be heated to a temperature in the range of 1000°–1500° C. without extensive melting of said mixture, and said heating step comprises heating said mixture of HLW calcine and said oxides to a temperature in the range of 1000°–1500° C. without extensive melting.

12. A process according to claim 1, wherein said mineral assemblage further contains crystals belonging to or possessing crystal structures closely related to at least one of the mineral classes selected from the group consisting of barium felspar ($BaAl_2Si_2O_8$), leucite ($KAlSi_2O_6$), kalsilite ($KAlSiO_4$), and nepheline ($NaAlSiO_4$).

13. A process according to claim 12, wherein said mineral assemblage contains crystals belonging to, or possessing crystal structures closely related to a combination of mineral classes selected from the group of combinations consisting of perovskite-hollandite-barium felspar-zirconolite-leucite-kalsilite, perovskite-hollandite-barium felspar-zirconolite-leucite, perovskite-hollandite-barium felspar-kalsilite-zirconolite, and perovskite-hollandite-barium felspar-nepheline-zirconolite.

14. A process according to claim 13, wherein said mineral assemblage comprises a perovskite-zirconolite-hollandite-barium felspar-kalsilite-leucite composition.

15. A process according to claim 1, wherein said oxides comprise at least four members selected from the group consisting of CaO, $TiO_2$, $ZrO_2$, $K_2O$, BaO, $Na_2O$, $Al_2O_3$, $SiO_2$ and SrO, one of said members being $TiO_2$ and at least one of said members being selected from the sub-group consisting of BaO, CaO and SrO.

16. A process according to claim 15, wherein said mixture is comprised of at least five members selected from said group, one of said members being $TiO_2$, at least one of said members being selected from the sub-group consisting of BaO, CaO and SrO, and at least one of said members being selected from the sub-group consisting of $ZrO_2$, $SiO_2$ and $Al_2O_3$.

17. A process according to claim 15, wherein in said group of oxides from which said oxides are selected, $Al_2O_3$ is replaced partly or completely by the oxides of Fe, Ni, Co or Cr.

18. A process according to claim 1 wherein said mineral assemblages correspond essentially to crystals belonging to, or possessing crystal structures closely related to the perovskite and the hollandite-type mineral classes.

19. A process according to claim 1, wherein said mineral assemblage consists essentially of crystals belonging to, or possessing crystal structures closely related to the zirconolite and the hollandite-type mineral classes.

20. A process according to claim 1 wherein said mineral assemblage consists essentially of crystals belonging to, or possessing crystal structures closely related to the perovskite, zirconolite and the hollandite-type mineral classes.

21. A process according to claim 1, wherein said oxides comprise at least three members selected from the group consisting of BaO, $TiO_2$, $ZrO_2$, $K_2O$, CaO, $Al_2O_3$ and SrO, one of said members being $TiO_2$ and at least one of said members being selected from the sub-group consisting of BaO, CaO and SrO.

22. A process according to claim 21 wherein said mixture is comprised of at least four members selected from said group, one of said members being $TiO_2$, at least one of said members being selected from the sub-group consisting of BaO, CaO and SrO, and at least one of said members being selected from the sub-group consisting of $ZrO_2$ and $Al_2O_3$.

23. A process according to claim 21 wherein in said group of oxides from which said oxides are selected, $Al_2O_3$ is completely or partly replaced by the oxides of Ni, Co, Fe or Cr.

24. A mineral assemblage containing a minor proportion of immobilised high level radioactive wastes, said assemblage comprising crystals belonging to or having crystal structures closely related to crystals belonging to mineral classes which are resistant to leaching and alteration in appropriate geological environments and comprising crystals belonging to or possessing crystal structures closely related to at least two of the titanate mineral classes selected from the group consisting of pervoskite ($CaTiO_3$), zirconolite ($CaZrTi_2O_7$) and hollandite-type ($BaAl_2Ti_6O_{16}$) mineral classes, and said assemblage having elements of said high level radioactive waste incorporated as solid solutions within the crystals thereof.

25. A mineral assemblage according to claim 24, further containing crystals belonging to, or possessing crystal structures closely related to at least one of the mineral classes selected from the group consisting of barium felspar ($BaAl_2Si_2O_8$), leucite ($KAlSi_2O_6$), kalsilite ($KAlSiO_4$), and nepheline ($NaAlSiO_4$).

26. A mineral assemblage according to claim 25 containing crystals belonging to, or possessing crystal structures closely related to a combination of mineral classes selected from the group of combinations consisting of perovskite-hollandite-barium felspar-zirconolite-leucite-kalsilite, perovskite-hollandite-barium felspar-zirconolite-leucite, perovskite-hollandite-barium felspar-kalsilite-zirconolite and perovskite-hollandite-barium felspar-nepheline-zirconolite.

27. A mineral assemblage according to claim 24, containing crystals belonging to, or possessing crystal structures closely related to a combination of the mineral classes perovskite-zirconolite-hollandite.

* * * * *